US006116818A

United States Patent [19]

Bitetto et al.

[11] Patent Number: 6,116,818

[45] **Date of Patent: *Sep. 12, 2000**

[54] UNDERWATER PLOW APPARATUS AND METHOD

[75] Inventors: James J. Bitetto, Carle Place, N.Y.; James Christopher Coyne; Frank Dominick Messina, both of New Providence, N.J.; Robert D. Smith, Basking Ridge, N.J.; Gerald E. Tourgee, Convent Station, N.J.

[73] Assignee: General Dynamics Advanced Technology Systems, McLeansville, N.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/841,055

[22] Filed: Apr. 29, 1997

[51] Int. Cl.[7] ..... F16L 1/12

[52] U.S. Cl. ..... 405/159; 405/161; 405/163; 405/164; 37/322; 37/323

[58] Field of Search ..... 405/159, 160, 405/161, 162, 163, 164, 165; 37/366, 370, 342, 322, 323, 324, 335, 905; 172/684.5, 699, 700, 722, 765, 770; 239/265.11, 265.13, 265.35

[56] References Cited

U.S. PATENT DOCUMENTS

| | | | |
|---|---|---|---|
| 3,333,432 | 8/1967 | Hale et al. | 405/164 |
| 3,338,060 | 8/1967 | Harmstorf | 405/163 |
| 3,576,111 | 4/1971 | Henry | 405/163 |
| 3,638,439 | 2/1972 | Niederer | 405/159 |
| 3,898,852 | 8/1975 | Ezoe et al. | 405/164 |
| 4,011,727 | 3/1977 | Suzuki et al. | 61/72.4 |
| 4,091,629 | 5/1978 | Gunn et al. | 405/165 |
| 4,129,992 | 12/1978 | Carlsson et al. | 405/164 |
| 4,362,436 | 12/1982 | Harmstorf | 405/161 |
| 4,458,766 | 7/1984 | Siegel | 175/25 |
| 4,812,079 | 3/1989 | Johnson et al. | 405/164 |
| 5,088,857 | 2/1992 | Harmstorf | 37/366 X |
| 5,462,389 | 10/1995 | Messina | 405/183 |

FOREIGN PATENT DOCUMENTS

| | | | |
|---|---|---|---|
| 2631359 | 11/1989 | France | 37/342 |
| 2019113 | 10/1979 | United Kingdom | 405/161 |

*Primary Examiner*—David Bagnell
*Assistant Examiner*—Jong-Suk Lee
*Attorney, Agent, or Firm*—Jenner & Block

[57] ABSTRACT

An ocean plow device and accompanying method which incorporate a passive plow blade and a jetter tool working in conjunction with one another to lower drawbar and increase cable deployment speeds. In order to avoid cavitation due to sand dilation, in one embodiment of the plow device, the jetter tool includes nozzles oriented in a downward and backward direction relative to the plow device which creates a flow pattern to turbulently remove surface soil in front of the jetter tool in a rapid manner. The jetter tool is pivotally suspended from a point in front of the passive plow blade, such that the jetter will be free to find its own equilibrium position. That is, the pivotal mounting enables the jetter tool to rotate upward in harder soils and become fully extended in softer soils in order to reach the equilibrium position. The passive plow blade behind the jetter tool provides a constant burial depth for the cable and also provides protection from side loads encountered during deployment. By utilizing the jetter tool, the present invention avoids forces due to the effect of pore water by creating a slurry through the mixing of high flow rate water with sand, and forming a trench in which the passive tool can follow. In one embodiment of the invention the passive plow blade is backward raked so as to be capable of riding up and over the obstacles thereby providing snag clearing and obstacle avoidance features.

33 Claims, 7 Drawing Sheets

UNDERWATER PLOW APPARATUS AND METHOD

BACKGROUND OF THE INVENTION

1. Field of the Invention

The present invention relates generally to underwater plow devices and more particularly to plow devices capable of making trenches for burying communications cables.

2. Description of Related Art

In order to protect undersea cables from hazards in the ocean environment, including fishing activity, shifting bottom conditions and even human intervention, undersea cables have been historically buried. The burial process usually requires that the cable be deployed by a surface ship feeding cable down to a self-propelled or towed sub-surface plow device or vehicle. Safe depths for cable burial depend on the hazards commonly encountered in that region of the ocean bottom. Typical burial depths are from one to six feet, where most commercial plows bury cable to a depth of one meter.

Most conventional sea plow designs prepare a trench by inserting a digging tool into the ocean bottom and dragging the plow behind a ship. This method is limited by the amount of force the ship can impart to the tool. As would be understood, great amounts of force are typically required for towing a plow at ocean depths because a passive (ship drawn) digging tool experiences increased plowing resistance due to the flow of pore water, i.e., water flow into the spaces or pores between the grains of sand. This occurs because the sand must shear in order for the digging tool to pass. In shearing, the grains must roll over one another. In so doing the spaces (pores) between the grains must expand. Water pressure in these pores must decrease in order to draw in water to keep the pores filled. The drag of this permeating pore water squeezes the grains together and in this way increases the frictional force required to shear the sand. Hence the pull force (referred to as drawbar) is increased. The faster and deeper the digging tool goes the greater the decrease in pore water pressure, and hence the greater the drawbar, up to a limiting speed where either cavitation (vacuum) occurs or where the grains begin to crush. The cavitation limit is a function of ocean depth. The grain crushing limit is a function of the sand properties.

Prior art plows for undersea burial of cable have typically consisted of either passive tools or some form of water assisted tool, each being pulled behind a ship. The purely passive plow tools tend to be forward or vertically raked with a forward raked toe to provide a downward force to maintain stability and keep the tool in the soil. These devices are limited to relatively low speeds in dense sandy soils because of pore water effects. Thus, for a ship with a maximum pulling capacity of 30,000 pounds, the maximum plowing speed in a very dense sand would be a small fraction of one knot, for example.

Water assisted plows are similar to the passive plow tools, however, they contain nozzles that introduce water directly in front of the digging tool. The idea is to provide water to feed the expanding pores of the dilating sand and thereby hopefully reduce drawbar. These tools achieve some drawbar reduction, but it is not clear whether this limited success is due to overcoming pore water effects or due to fluidizing sand and flushing it away. In either case, however, these tools are susceptible to clogging by becoming jammed with sand. Also, these tools have a potential startup problem. If the plow speed becomes too great, the solid sand wall can come in intimate contact with the blade, shutting off the jets. If this happens, drawbar increases, the tow cable stretches, and the solid sand wall becomes spring loaded against the leading edge of the blade. In this situation it is unlikely that the jet flow can be reestablished. Backing the tow ship in order to unload the tow cable is an undesirable option.

Because of the towing forces required to operate the undersea plowing devices, large, specialized cable ships capable of providing large towing forces are still necessary. However, these cable ships exist in limited number. Accordingly, there is a need in the art of undersea trenching to provide a plow device that reduces the towing forces presently required. This would increase the number of ships which are capable of laying cable, and reduce the expense and delay encountered with the use of traditional plows.

SUMMARY OF THE INVENTION

The present invention is an ocean plow device and accompanying method which incorporate a passive plow blade and a jetter tool working in conjunction with one another to lower drawbar and increase cable deployment speeds. In order to avoid cavitation due to sand dilation, in one embodiment of the plow device, the jetter tool includes nozzles oriented in a downward and backward direction relative to the plow device which creates a flow pattern to turbulently remove surface soil in front of the jetter tool in a rapid manner. The jetter tool is pivotally suspended from a point in front of the passive plow blade, such that the jetter will be free to find its own equilibrium position. That is, the pivotal mounting enables the jetter tool to rotate upward in harder soils and become fully extended in softer soils in order to reach the equilibrium position. The passive plow blade behind the jetter tool provides a constant burial depth for the cable and also provides protection from side loads encountered during deployment. By utilizing the jetter tool, the present invention avoids the effects of pore water by creating a moving slurry through the mixing of high flow rate water with sand, and forming a trench in which the passive blade can follow. In one embodiment of the invention the passive plow blade is backward raked so as to be capable of riding up and over the obstacles thereby providing snag clearing and obstacle avoidance features. Additionally, wing features oriented on the sides of the plow blade may be included for stability and to ensure downward penetration of the plow blade.

BRIEF DESCRIPTION OF THE DRAWINGS

For a better understanding of the present invention, reference is made to the following description of an exemplary embodiment thereof, considered in conjunction with the accompanying drawings, in which.

The drawings are not to scale.

DETAILED DESCRIPTION

Although the present invention is particularly well suited for creating trenches for burial of telecommuunications cables, and shall be described with respect to this application, the present invention can also be applied to many other types of underwater excavation activities which require trench creation, including but not limited to, pipeline construction, underwater terrain analysis and pipeline or cable location procedures.

Figure 1:
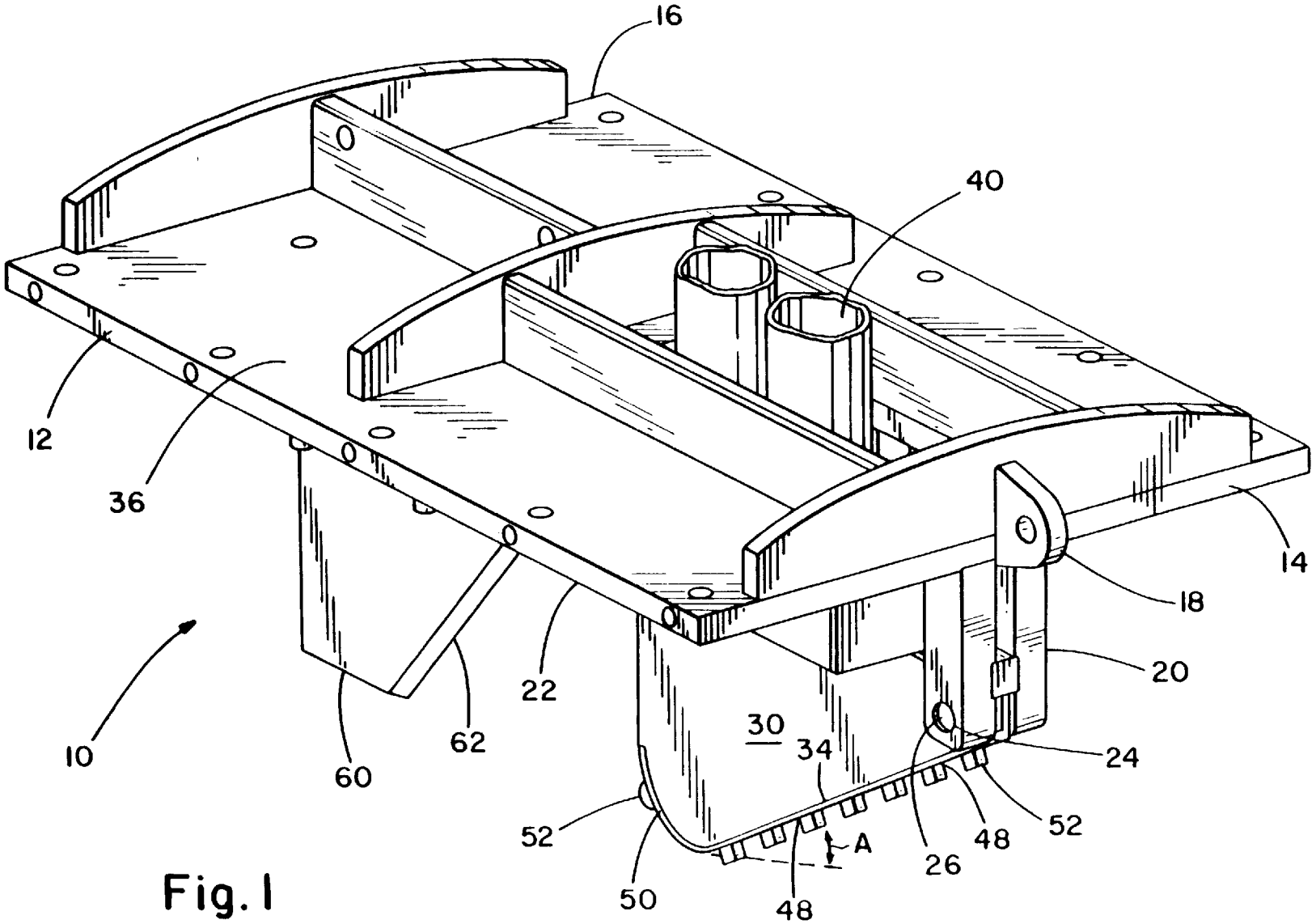
FIG. 1, is a perspective view of one embodiment of an ocean plow in accordance with the present invention.

Referring now to FIG. 1, there is shown one embodiment of an underwater plow 10 in accordance with the present invention, which is adapted to create a trench in an underwater surface for burial of cable. As shown, the underwater plow comprises a generally rectangular plow base 12 having a leading edge 14 or front end and a trailing edge 16 or back end. A tow point 18 is attached to the leading edge 14 and is adapted to receive a cable from a towing ship and transfer the towing force (called drawbar) to the base 12 of the ocean plow 10. A tool mount 20 is attached to a bottom surface 22 of the base 12 at or near its leading edge 14. The tool mount 20 defines an aperture 24 which is adapted to receive and hold a pivot 26 or other suitable fastening means.

A jetter tool assembly 30 is pivotally mounted to the tool mount 20, wherein the jetter tool assembly is movable about the pivot 26 in a generally vertical plane. This movement, however, is limited by biasing means 32 (shown in FIGS. 2–6) which are interspersed between the jetter tool assembly 30 and the base 12 of the plow 10. The biasing means 32 may be a spring or hydraulic piston and may also comprise damping means such as a dashpot or shock absorber to control vibration and bounce of the jetter tool as it progresses along the undersea surface. In all cases the biasing means exerts a force which urges a leading edge of the jetter tool assembly 30 forward and downward, such that the jetter tool assembly maintains a minimum depth in the underwater surface as the plow 10 is towed. In typical operation, an angled front face 34 of the jetter tool assembly makes an acute angle A ranging from 20 to 70 degrees with the undersea surface. Although the jetter tool assembly is shown as being pivotally coupled to the tool mount 20, it would be understood that the jetter tool assembly could also be mounted directly to the base 12 of the plow device.

A top surface 36 of the base is adapted to support at least one variable speed submersible pump 38 (shown in FIG. 2), having an intake 39 to accept sea water, for example, and an output which couples to an intake 40 of the jetter tool assembly 30. The pump 38 is powered through a control cable 42 which may be an independent cable or part of the tow cable, where the control cable couples to a control distribution block 44 on the base 12 of the plow. The control cable 42 is often times referred to as an umbilical cable, since the power and other control functions which are transferred through the control cable are provided from the tow vessel. The output of the pump 38 is connected to the intake 40 of the jetter tool assembly, for example, by a conventional fire hose, a coiled tube which can expand and contract or any other conventional water transport device 46. As shown in FIG. 1, the jetter tool assembly 30 includes a series of vents 48 located on the front face 34 and bottom 50 also referred to as leading edge and bottom edge, respectively of the jetter tool. As will be explained in greater detail, the pump conducts a predetermined volume of water into the jetter tool assembly 30 which is then output from the vents 48 to essentially wash away sand and other like matter in a path in front of the jetter tool. As shown, the vents 48 may include orifice controls 52, for example, variable nozzles. The orifice controls 52 may be mounted to the jetter tool assembly 30 but may also be built in directly. Other orifice controls besides nozzles may also be utilized, as explained herein.

A passive plow blade 60 mounts to the bottom surface of the plow base by bolts, a weld, or any other device well known the art of fastening. The passive blade 60 is shown in a back-raked orientation, where a leading edge 62 thereof forms an acute angle with the undersea surface ahead of the passive blade. The back-raked angle of the passive plow blade typically ranges from about 20 degrees to about 70 degrees. The back-raked blade 60 shown in FIG. 1 is advantageous in that it has a tendency to ride over obstacles disposed on the ocean floor or embedded in it which prevents snags and enables obstacle avoidance. Additionally, the passive blade may include wing features 64 (shown in FIGS. 2 and 3) located on each side of the plow blade, and extending outwardly from each side. The wing features 64 will preferably be oriented at an acute angle relative to a bottom edge 65 of the plow blade. The wing features serve the purpose of providing added stability as well as ensuring that the plow blade penetrates downwardly into the underwater surface to be plowed when the plow 10 is traveling forward. Although the example uses a back-raked passive blade, it would be understood that other well known leading edge configurations, such as a straight blade which makes a ninety degree angle with the underwater surface, or a forward-raked configuration which makes an obtuse angle with the surface to be plowed may also be utilized. The plow blade may also include an aperture and guide means 66 for accepting the cable 67 to be buried and guiding the cable into the trench made by the jetter tool assembly and plow blade. It would also be understood by a person skilled in the art that the height or the depth of penetration of the plow blade 60 into the underwater surface may be remotely adjusted, for example, hydraulically, by way of a blade controller 68 and commands issued through the control cable 42 and the distribution block 44.

Figure 2:
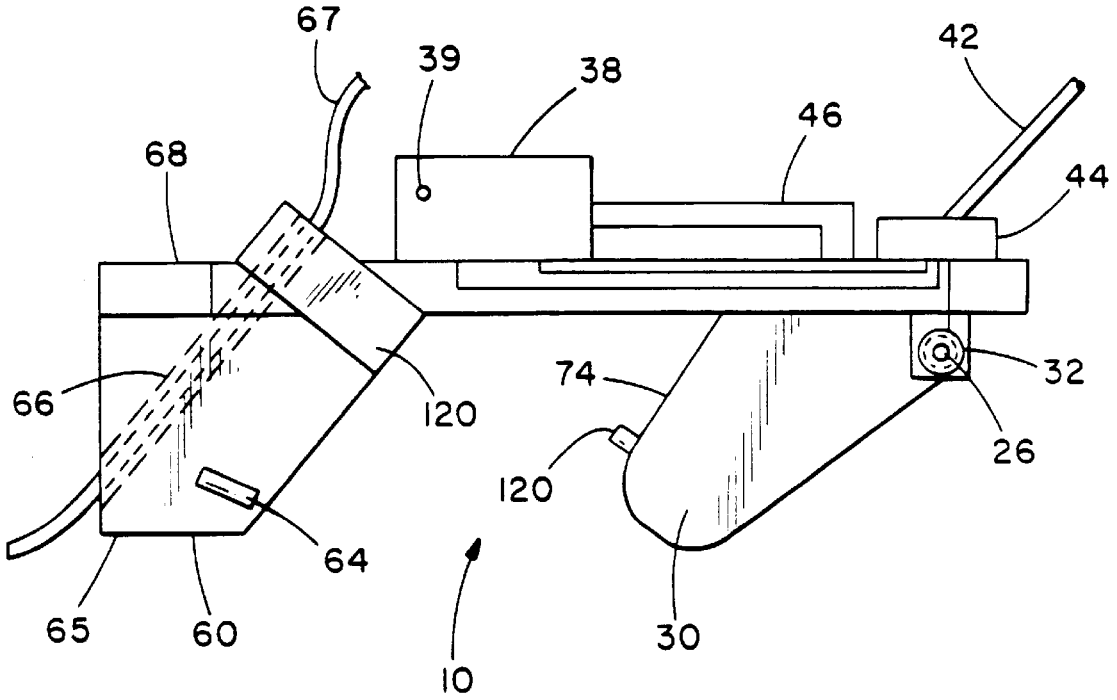
FIGS. 2 is a side view of an alternate embodiment of the ocean plow in accordance with the present invention and which illustrates one methodology for a biasing means for the jetter tool assembly.
Figure 3:
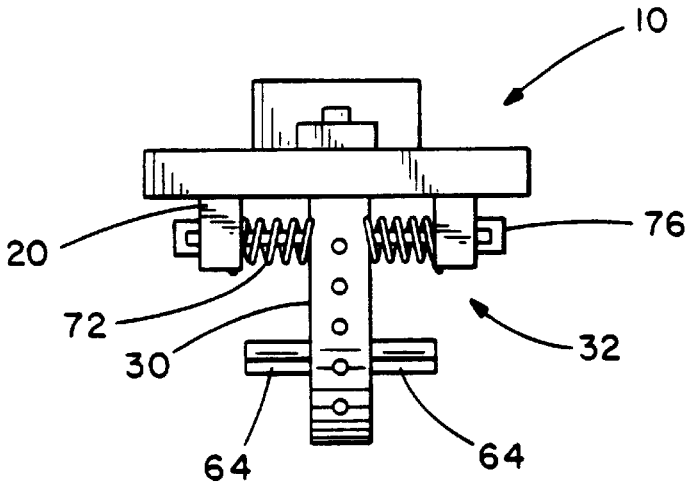
FIG. 3 shows a front view of the embodiment of the ocean plow shown in FIG. 2.
Figure 4:
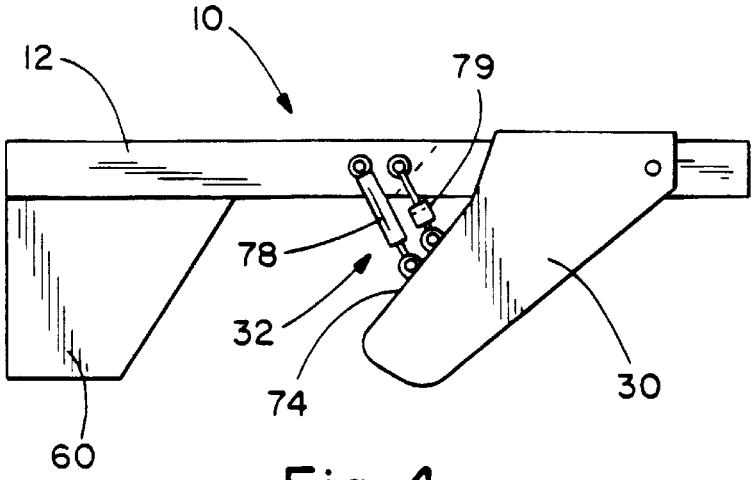
FIG. 4 shows another embodiment of the present invention ocean plow illustrating alternate biasing means.

Referring now to FIGS. 2 and 3, a front view of one embodiment of the inventive underwater plow 10 is shown, illustrating one methodology for implementing the biasing means 32. In this and other figures like components are referred to with like reference numerals. As shown, the jetter tool assembly 30 includes torque springs 72 wrapped about the pivot 26 which are, in turn, coupled to the jetter tool assembly 30 and the tool mount 20 (on both sides of the jetter) to provide an appropriate bias. Angular dampers 76 are mounted on the opposite sides of the tool mount 20 to provide a shock absorbing effect and help dampen vibration and bounce as the plow device proceeds along the underwater surface. FIG. 4 shows an alternate biasing means 32 for the present invention which includes a hydraulic cylinder or spring 78 (to provide bias) used in conjunction with a dampener 79. Both the hydraulic cylinder or spring 78 and the dampener 79 are shown fastened between the trailing edge 74 of the jetter tool assembly and the base 12 of the ocean plow 10.

Figure 5:
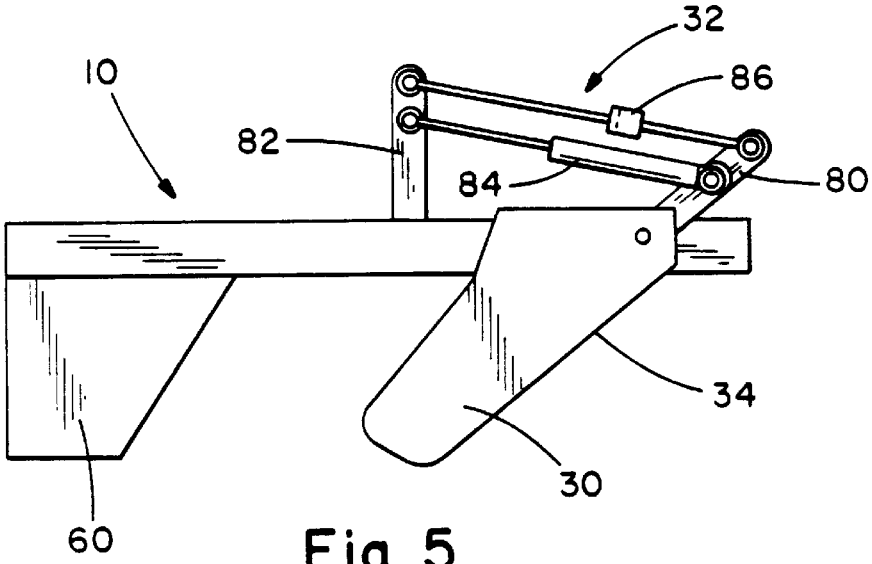
FIG. 5 shows a further embodiment of the present invention illustrating another alternate biasing means.

FIG. 5 shows an alternate arrangement for implementation of the biasing means 32 in accordance with the present invention. As shown the jetter tool assembly 30 includes an extension flange 80 which is generally parallel to the front face 34 of the jetter tool assembly and protrudes upwardly therefrom. The base 12 of the plow 10 further includes an extension mount 82 extending upwardly from the top surface 36 thereof and located generally between the mounting of the jetter tool assembly 30 and the passive plow blade 60. A hydraulic cylinder 84 and damper 86 are shown coupled to both the extension flange 80 and the extension mount 82 to provide the biasing means. The instant implementation of the biasing means 32 is advantageous due the variability in the hydraulic cylinder 84 in being able to control force and displacement.

Figure 6:
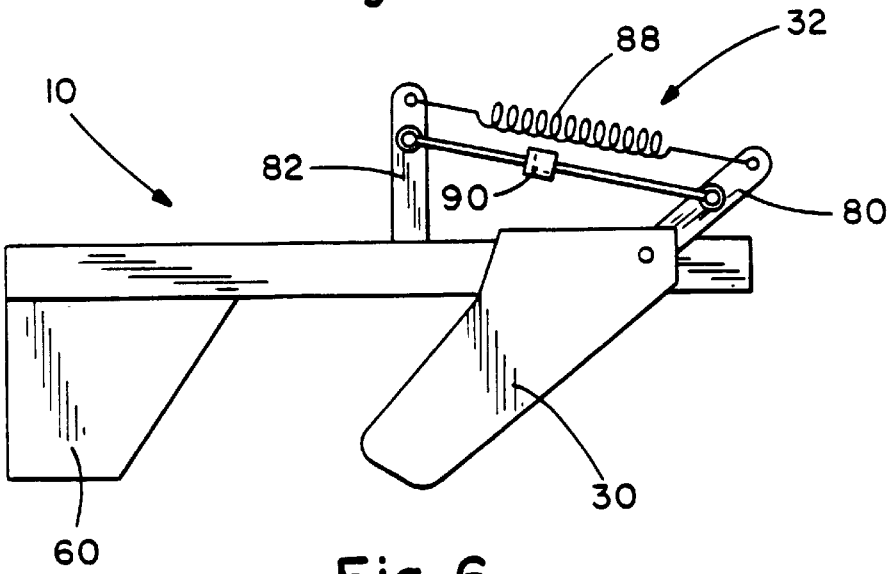
FIG. 6 shows a further embodiment of the present invention illustrating another alternate biasing means.

FIG. 6 shows another alternate arrangement for implementation of the biasing means 32 which also includes an extension flange 80 and extension mount 82 similar to that of FIG. 5. Rather than the hydraulic cylinder, the biasing means 32 of FIG. 6 includes a spring 88 used in conjunction with the a dashpot dampener 90, wherein the spring 88 and dampener 90 mount between the extension flange and the extension mount. Each of the biasing means 32 described with respect to FIGS. 2–6 will have provisions for coupling to the control distribution block 44 such that the force and/or dampening effects provided by the biasing means may be remotely adjusted from the towing vessel, for example, based on changing soil conditions. The adjustment may take place utilizing electrical signals transmitted through the control cable 42 to a transducer located at or near the biasing means which effects an adjustment thereto.

Figure 7:
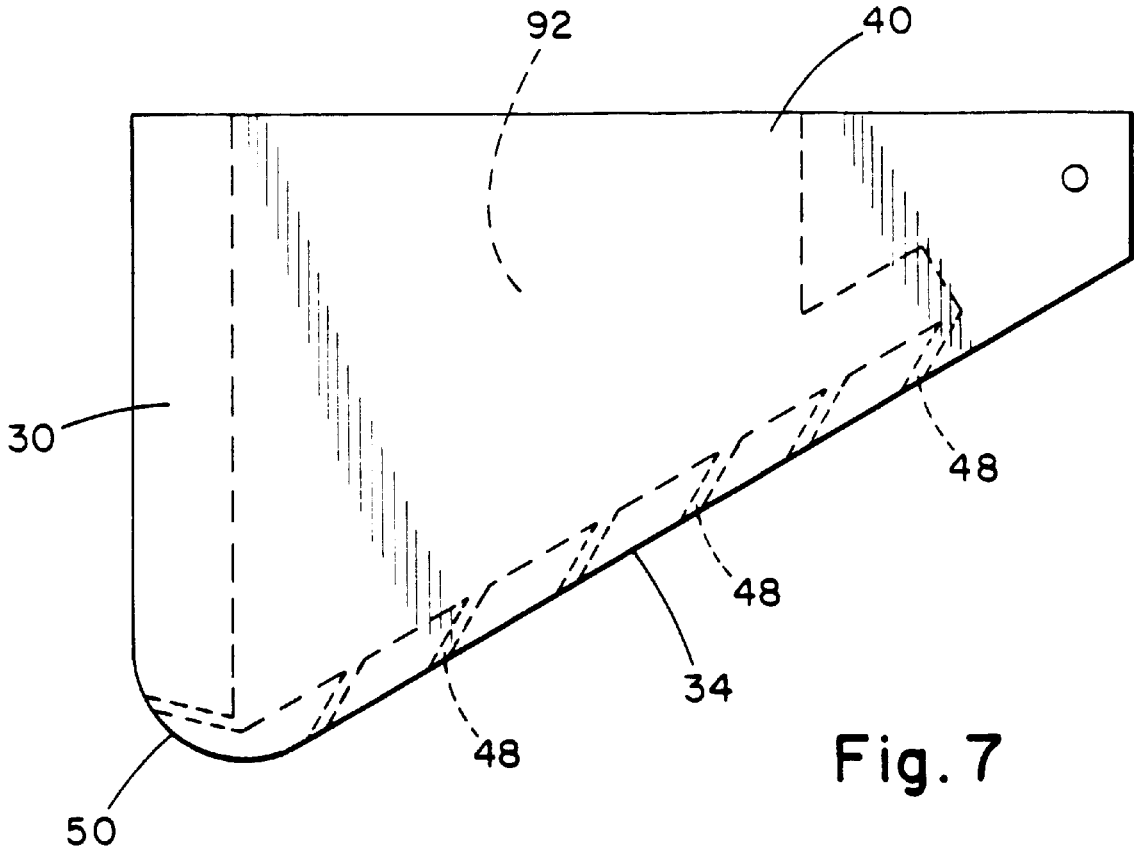
FIG. 7 shows a detailed view of the jetter tool assembly used in connection with the ocean plow of the present invention.

Referring to FIG. 7 there is shown an enlarged view of the jetter tool assembly 30. The jetter tool defines the intake 40 which penetrates a top edge of the jetter tool. The intake feeds a chamber 92 which in turn feeds a multiplicity of vents 48 which penetrate forward edge 34 and/or bottom edge 50. The vents 48 may be perpendicular to the leading and bottom edges 34, 50, respectively, but in a preferred embodiment they intercept these surfaces at an acute angle ranging from 10 to 90 degrees so that water from the pump is forced through the intake 40 and chamber 92 to each of the vents 48 to be directed backward and downward relative to the motion of the ocean plow. In one advantageous embodiment, the angle made by the vents with their respective edges is 20 degrees. As would be understood, the backward rake of the jetter tool assembly 30 permits the jetter tool to ride over obstacles in a similar fashion to the backward raked plow blade. Additionally, the intake 40 and chamber 92 could be replaced with a series of pipes or hoses which feed each vent.

Figure 8:
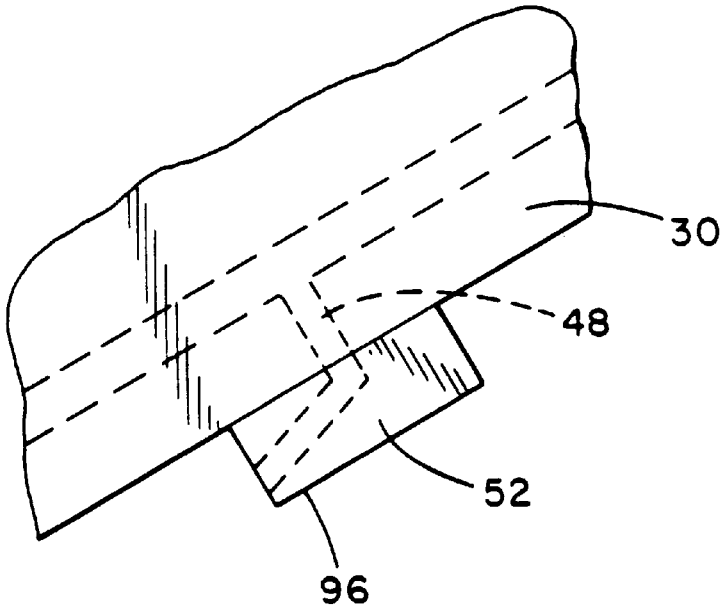
FIG. 8 shows one embodiment to accomplish orifice control for the vents of the jetter tool assembly.

Referring now to FIG. 8, there is shown a portion of an alternate embodiment of a jetter tool assembly 30 where one of the vents includes an orifice control 52 depicted as an external nozzle 96. The external nozzle 96 is mounted along leading edge and/or bottom edge of the jetter tool assembly 30. Each nozzle 96 is fed by a vent 48 which is perpendicular to its respective surface. Each nozzle is adapted to direct a flow of water from its vent at an angle ranging from 10 to 90 degrees from the edge to which it is mounted. An angle closer to 90 degrees is advantageously used in more cohesive soils, like clay, in order to maximize the impinging effect of the water or other liquid which is output from the jetter tool assembly. Advantages of this arrangement are a simplicity of machining vents 48 in the jetter tool assembly 30 and the ease and lessened expense of replacing a damaged nozzle versus replacing the whole jetter tool if vents 48 become damaged.

Figure 9A:
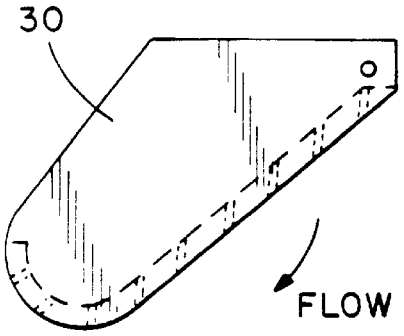
FIGS. 9A and 9B show side and front views of the jetter tool illustrating an alternate orifice area control scheme.
Figure 9B:
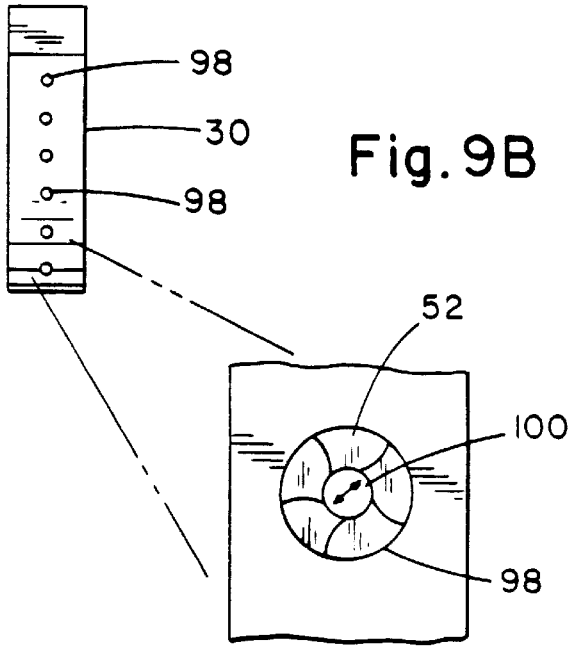

FIG. 9A and 9B show an alternate embodiment of the jetter tool assembly where the orifice control means 52 includes variable flow nozzles 98. As shown a nozzle includes an adjustable pupil 100 within, which may be dilated back and forth to adjust the orifice area in the nozzle. By adjusting the orifice area of the pupil 100, the effective nozzle size may be varied according to a desired flow pattern, including direction and volume. As would be understood, the orifice area of the variable flow nozzles 98 may be controlled either mechanically or electrically, wherein the orifice area control mechanism couples to the control block 44 on the base 12 of the plow 10 such that the orifice area may be remotely controlled from the ship through the control cable 42. A person skilled in the art would understand that the control block, blade control, biasing means and/or orifice control means will include suitable means, such as a digital processor, A/D converters or mechanical transducers to translate electrical signals transmitted via the control cable to appropriate electrical signals or mechanical motion.

Figure 10:
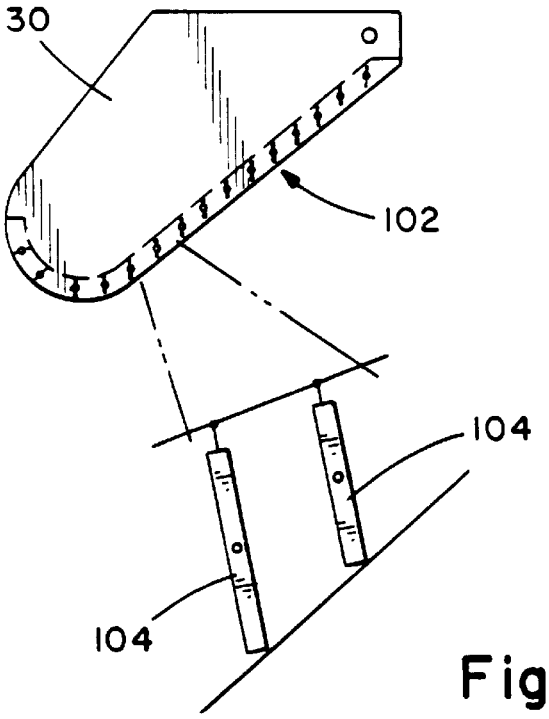
FIGS. 10 and 11 show side and front views of the jetter tool illustrating another alternate orifice area control scheme.
Figure 11:
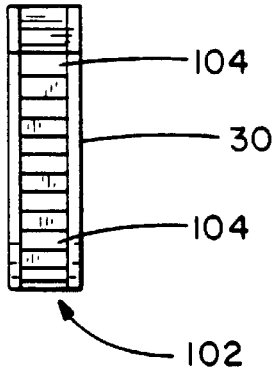

FIG. 10 and 11 show an alternate depiction of the jetter tool assembly 30 which includes a baffle/venetian blind arrangement 102 acting as the orifice control means 52. In one embodiment of a baffle/blind arrangement 102 for the jetter tool, a plurality of shutters 104 are mounted on the jetter tool assembly 30 near the vent areas 52. Each shutter 104 rotates to create a set area and direction of flow. Movement of the shutter in one direction or another acts to increase or reduce flow area and change direction of flow. Operation of the baffle/blind arrangement 102 will be controlled remotely in a similar fashion described with respect to FIG. 9A and 9B.

Figure 12:
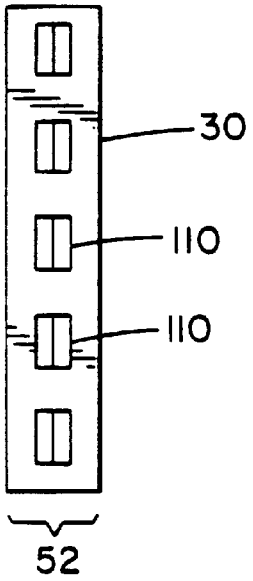
FIGS. 12, 13, 14 and 15 show other alternate orifice area control schemes.
Figure 13:
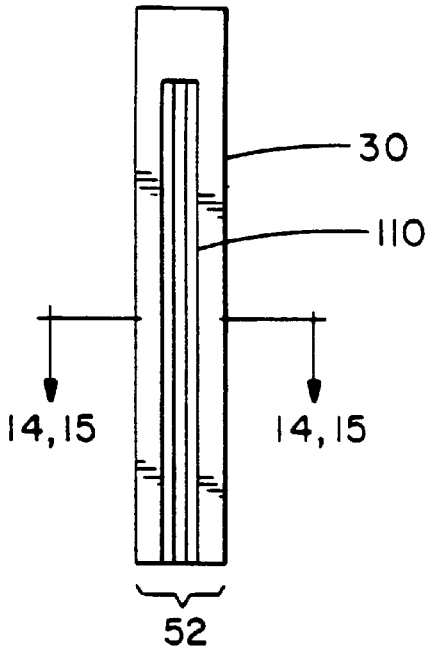
Figure 14:
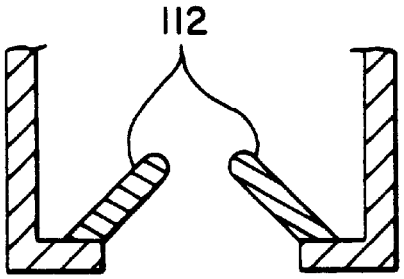
Figure 15:
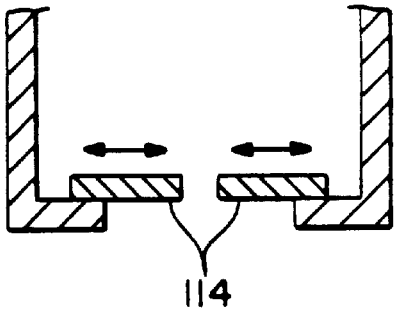

FIG. 12, 13, 14 and 15 show other alternate arrangements for the orifice area control means 52. FIG. 12 and 13 depict the orifice area control means 52 as one or more vertical slits 1 10, where FIG. 12 shows a series of vertical slits and FIG. 13 shows a single slit. Flow is controlled through the one or more vertical slits by way of hinged shutters 112 (FIG. 14) or sliding shutters 114 (FIG. 15). Operation of the shutters will also be controlled remotely as discussed previously.

Referring again to FIGS. 2 and 3 in combination, the inventive underwater plow 10 may also include an eductor mechanism 120 which further assists in movement of the slurry through the trench. The eductor 120 is preferably located somewhere at or near the trailing edge 74 of the jetter tool assembly 30 which acts to create a lower pressure region behind the jetter tool assembly to provide a lower impedance path for the water flow. The eductor 120 may take the form of one or more additional nozzles located at the back of the trailing edge 74 of the jetter tool assembly 30 or on the plow base 12. Alternately, the eductor may be any other device which acts to create a reduced pressure region behind the jetter tool assembly to assist in movement of the slurry flow. The eductor 120 may also be coupled to the control distribution block 44 so that it is capable of being remotely controlled by way of the control cable 42.

The operation of inventive plow 10 capitalizes on the washing effect created by the jetter tool assembly 30. Advantageously, the jetter tool assembly 30 of the present invention creates high flow (not pressure) and directed flow (i.e., momentum driven rather than pressure driven). The flow sweeps down the front and under the back of the jetter tool assembly 30, such that a low resistance path for a slurry flow from ahead of to behind the plow blade 60 is created. The present invention ensures that a lower resistance path (flow channel) always exists, and that the plow blade 60 does not come in intimate contact with the sand wall ahead of it, cutting off the channel, for example by clogging of the nozzles or some other stagnation of water flow.

It should be noted that with the prior art plow devices, such as the water assisted plows, the flow channel would often be cut off, for example, due to clogging or when achieving too high a rate of speed. With a long elastic tow cable pulling the plow, it many times is not possible to reestablish the flow channel once it collapses, since backing up the plow or removing the tow tension is not an option because the cable laying procedure would become disrupted. Thus, these prior art plow devices are considered to be either too slow or too unreliable because of their propensity to stall.

It is recognized that a way around this potential stalling problem is to make the jetter tool independent of the plow blade 60. The jetter tool 30, as described, is a backward inclined structure with orifices directed generally parallel to its front surface, that prepares the soil ahead of the conventional passive plow blade 60. By being backward inclined, the flow resistance is decreased because the angle of flow direction change at the bottom of the jetter is reduced. By having the jets directed essentially parallel to the front face of the jetter tool assembly and directed backward toward the passive plow blade 60, momentum is imparted in the direction of slurry flow. With this arrangement, pressure in the slurry flow channel created by the jetter is nearly ambient sea pressure, and the flow is nearly completely momentum driven.

As shown in FIG. 1, this backward inclined jetter tool assembly 30 structure is pinned near its top and is provided with a means of small bias force (spring or hydraulic piston) so that it can automatically adapt to changing soil conditions, plow speed and jet flow. Accordingly, the jetter structure will automatically seek an equilibrium angle as a function of jet flow, soil conditions and speed. Preferably, the bias force is small enough such that stalling (cutting off the slurry flow channel) will not occur, but large enough to ensure it can overcome the small slurry pressure that might exist in the channel.

The slurry flow down the front face and underneath the jetter tool assembly 30 establishes the boundaries of a trench of fluidized soil ahead of the passive plow blade 60. If the passive plow blade is shallower than the fluidized trench, there will be virtually no towing forces required to move the passive plow blade. If the passive plow blade 60 is deeper than the fluidized trench, then towing forces will be encountered. Thus it can be seen that the work of plowing can be apportioned between the jetter assembly 30 and the passive plow 60. The more flow issued by the jetter tool, the deeper will be fluidized trench, and the smaller will be the drawbar. The advantage here is that power (kilowatts delivered via the tow cable) can be traded off with drawbar. By achieving a reduction in drawbar necessary to operate the plow 10, smaller, less expensive vessels may be utilized to carry out cable burial. The use of smaller alternative vessels can result in a tremendous cost savings for such cable burial tasks.

Experiments have shown that the flow rate (Q) supplied by the pump or pumps should exceed a certain value. To achieve a fluidized trench of at least width W and depth D at a plowing speed V, the total jet flow should exceed approximately one half W times D times V. This can be represented as:

$$Q>N\times W\times D\times V$$

where N is 0.5. In order to achieve minimum drawbar, the width W and depth D of the trench should exceed the width and depth of the passive blade. It would also be understood that for values less than N=0.5 that some drawbar reduction will still take place although the dimensions of the trench would be reduced. Also for values greater than N=0.5, it would be understood that the dimensions of the trench would increase.

Figure 16:
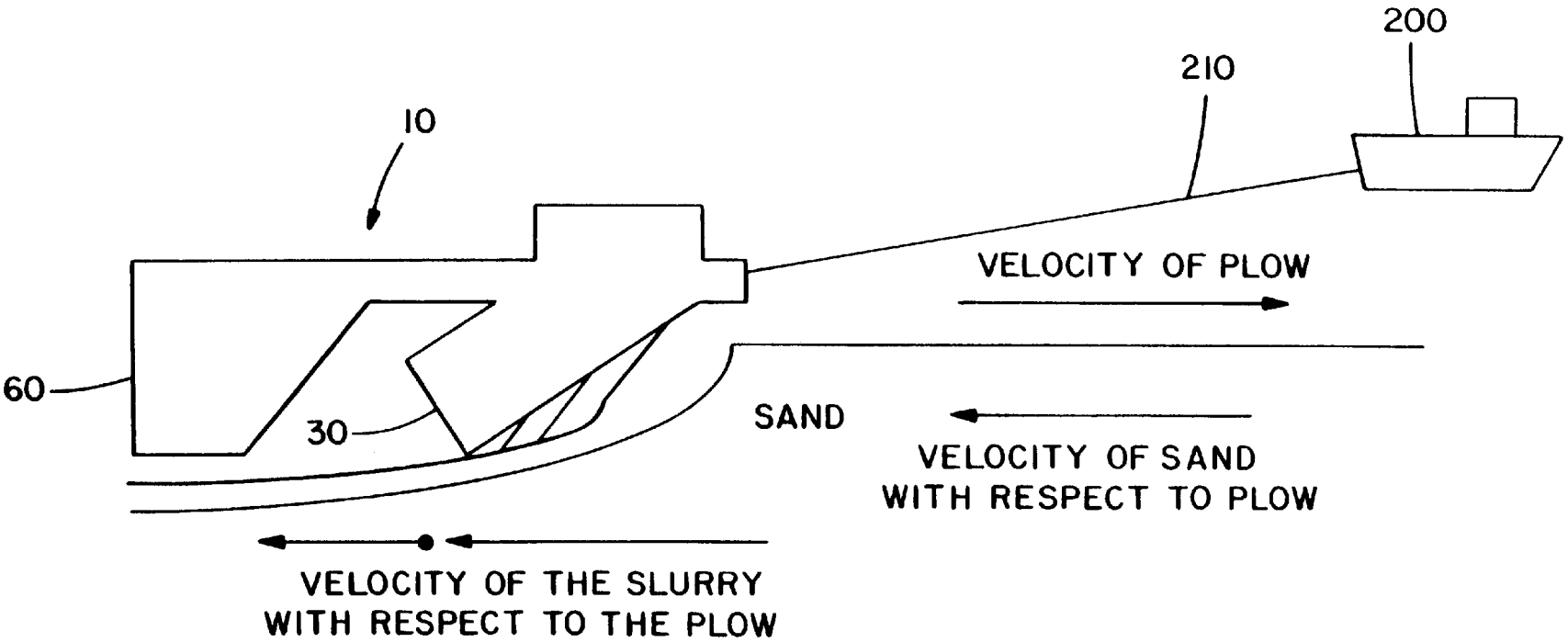
FIG. 16 shows a graphical illustration of the operation of the ocean plow in accordance with the present invention.

FIG. 16 graphically illustrates the advantages of the present invention ocean plow device 10 over the prior art. As shown, the ocean plow device 10 is pulled by tow vessel 200 having a cable 210. As discussed, the jetter tool assembly 30 is designed to create a slurry flow and form a swept trench in front of the passive plow blade 60. In a preferred embodiment, the desired direction of slurry flow is down the front face, underneath and to the rear of the jetter assembly. Accordingly, the jets are pointed in this preferred direction, parallel to the desired path, imparting momentum to the slurry flow all along its way. Flow losses along the path are compensated by the momentum additions; hence there is little need for pressure gradients to drive the flow. Ideally, the entire slurry channel is at ambient sea pressure, where the slurry flow is momentum driven rather than pressure driven.

In prior art, possibly under the mistaken belief that one must "cut through" the sand, the nozzles were directed forward into the sand. As a result of this misdirection, the momentum and kinetic energy of the jets were not effectively used in flushing away the slurry. Here, the jet momentum was directed forward, opposite to the direction that the slurry must ultimately flow. The kinetic energy of the jets were largely dissipated; a portion being converted to pressure. This pressure, which builds up in a pocket in front of the jetter, provided the driving force for the inefficient removal of the slurry.

Also, in the prior art, the water jets were an integral part of the plow blade. This integration met with only limited success because the requirements for jetting and drawbar plowing are mutually incompatible. Drawbar plowing requires physical contact between the leading edge of the plow blade and the soil. Jetting, requires soil-free space in front of the leading edge, both to discharge into and also to provide a low impedance flow path to carry the slurry away. Also, there are incompatibilities with regard to the need for structural strength of the blade in drawbar plowing versus the need for low resistance flow passages within the blade in jetting.

The water assisted plow of the prior art tended to operate in either of two modes. At sufficiently low speed it operated as a jetter with virtually no physical contact between the blade and soil, and therefore low drawbar. At higher plowing speeds, because soil could not be fluidized and flushed away fast enough, the jets became cut off, and the device reverted to a drawbar plow. Once jetting has been cut off it is unlikely to be re-established. The tow cable, a long elastic member whose stretch is typically several feet, maintains a high physical contact force between the blade and the solid soil. Thus, once stalled, the jetter may not be started again without backing up the tow ship to slacken the tow cable and possibly backing up the plow in order to re-establish the needed soil-free space in front of the blade.

In developing the present invention, certain concepts relating to underwater plowing were thoroughly investigated, which enabled the present invention to improve performance significantly over the devices in the prior art. First, it was recognized that the hardest soil (requiring the greatest drawbar) is fine densely-packed cohesionless sand. However, the force necessary to remove sand, grain by grain, is very small. Even for the most dense sand, the fluid shear stress necessary to entrain grains into a turbulent water stream flowing parallel to the sand surface is much less than 1 psi. Thus, in cohesionless sand, there is no need for direct impingement of the jet.

It was also recognized that when sand is excavated by flushing it away grain by grain, pore water effects are not a significant issue. That is, with excavation in this manner, there is no stress in the bulk sand, no fracture plane, no dilation, and no need for pore water to permeate large distances to fill the expanding void space between grains.

The major obstacle then, to high speed jetting, is removing the slurry created by flushing. To achieve high speed slurry removal, an unrestricted, low impedance, flow path is required which transports the slurry from ahead of to behind the jetter. To ensure the slurry flow path is low impedance, the sand concentration of the slurry must be relatively low; hence the need for high flow rates. Also changes in flow direction should be kept to a minimum. It was also recognized that there should exist no large force pressing the jetter forward against the soil. Such a force, if it were caused by physical contact with the solid sand, could reduce or completely cut off the slurry flow path. If the force were caused by fluid pressure, then the jet flow would be reduced. In either case, large jetter forces are incompatible with high speed jetting.

Taking the preceding into account, in one embodiment of the present invention, the nozzles are directed parallel to the intended preferred flow path, rather than outwardly as in the prior art. Large flow rates, for example, hundreds or even thousands of gallons per minute depending on jetter size, are also used to keep the sand concentration of the slurry at a modest level. The nozzles are also arrayed fairly uniformly along the leading edge of the jetter assembly in order to keep the sand concentration fairly uniform along the flow channel.

Next, the jetter assembly is completely divorced from the passive blade, and is pivoted and biased in such a way that large forces cannot squeeze down on the slurry flow path and thereby increase the flow impedance. Finally, the jetter assembly is inclined backward such that the flow direction change at the bottom is small. This inclination also reduces snagging and impact shock on buried and semi-buried obstacles.

The table below provides representative data illustrating increased performance characteristics achieved during tests of the present invention ocean plow. As can be seen, significant reduction in drawbar and increases in speed were achieved as the flow of water through the jetter tool was increased.

| Test | Flow (gpm) | Speed (knots) | Drawbar (lbs) |
|---|---|---|---|
| Passive Blade only | 0 | .7 | 6000 |
| Jetter Test A | 100 | .84 | 1452 |
| Jetter Test B | 225 | 1.75 | 112 |
| Jetter Test C | 310 | 2.95 | 150 |

The invention provides a redundant system in which a passive blade can be used independently of the jetter tool. The apparatus provides a lower drawbar for commercial plows while allowing the achievement of higher speeds. Accordingly, smaller ships could be used for deployment of cable or undersea equipment due to the lower drawbar resulting in less money expended. Obstacle avoidance is gained by jetter rotation and back-raked passive tool. Moreover, the present invention avoids the clogging problem encountered by water assisted plows. Additionally, the design is self-starting since the direction of the jet nozzles are in the direction of slurry flow. In operation, the drawbar (force) applied to the tow point by the towing ship is minimized by adjusting the flow of the pump which directs a flow of water with a momentum downward and backward away from the leading and bottom edges, respectively. In this way, the jetter tool flushes sand away from itself thereby decreasing drawbar.

Changes and modifications in the specifically described embodiments can be carried out without departing from the scope of the invention. In particular, the drawbar force could be further reduced by supplying energy to an engine driving tracks or wheels integrated with the ocean plow to drive it along the undersea surface. Moreover, in some applications the jetter tool assembly may be used alone without the passive blade. Additionally, it may be appropriate for the plow device to travel on rails or skis. Also, other cable handling devices and obstacle avoidance mechanisms, such as, sonar may be included. It will be understood that the embodiments of the present invention specifically shown and described are merely exemplary and that a person skilled in the art can make alternate embodiments using different configurations and functionally equivalent components. All such alternate embodiments are intended to be included in the scope of this invention as set forth in the following claims.

We claim:

1. A plow apparatus for making a trench in an underwater surface comprising:

a base including a front end and a back end;

a jetter tool assembly including a leading edge and a bottom edge, said jetter tool assembly coupled to said base proximate said front end and extending downwardly from said base, said jetter tool assembly including, an intake for accepting a volume of liquid input thereto; and at least one vent disposed at said leading edge, said vent being coupled to said intake and operable to output said volume of liquid substantially parallel to said leading edge at a predetermined rate of flow such that said flow is directed backward relative to said leading edge of said jetter tool assembly.

2. The apparatus of claim 1, further including a pivotal mount for coupling said jetter tool assembly to said base, wherein said jetter tool is enabled to rotate about said pivotal mount for establishment of an equilibrium position in said underwater surface.

3. The apparatus of claim 2 further including biasing means coupled to said jetter tool assembly for applying a bias force against said jetter tool assembly to achieve a given depth in said underwater surface.

4. The apparatus of claim 3, wherein said biasing means further includes dampening means.

5. The apparatus of claim 3, wherein said biasing means are selected from the group consisting of a spring and hydraulic cylinder.

6. The apparatus of claim 2 wherein the leading edge of the jetter tool, at equilibrium position during towing, makes an acute angle ranging from 20 to 70 degrees with the undersea surface, said leading edge of said jetter tool assembly being backward raked.

7. The apparatus of claim 1, wherein said at least one vent is further disposed on a bottom edge of said jetter tool assembly, said flow being directed down said leading edge and underneath said bottom edge, thereby creating a low resistance path for a slurry flow from ahead of said jetter tool assembly to behind said jetter tool.

8. The apparatus of claim 1, wherein said at least one vent further includes orifice control means for directing said flow of said liquid.

9. The apparatus of claim 8, wherein said orifice control means is selected from the group consisting of one or more nozzles, adjustable pupils, baffle arrangements, and moveable slits.

10. The apparatus of claim 8, wherein said orifice control means direct said flow of said jetter tool assembly at an angle ranging from 10 to 90 degrees relative to an edge of said jetter tool assembly.

11. The apparatus of claim 1, further including a submersible pump for directing said volume of liquid into said intake of said jetter tool assembly.

12. The apparatus of claim 11, wherein the rate of flow supplied by said pump exceeds one half width W times depth D times plowing speed V to achieve a fluidized trench of at least said width W and said depth D at said plowing speed V.

13. The apparatus of claim 11, wherein a flow rate supplied by said pump of less than one half width W times depth D times plowing speed V achieves an amount of drawbar reduction in creating a trench of at least said width W and said depth D at said plowing speed V.

14. The apparatus of claim 1, further including at least one control device for controlling adjustable features of said plow apparatus, said control device adapted to receive remotely transmitted commands by way of a control cable which couples to a control distribution point on said plow apparatus, said control device being coupled to said control distribution point.

15. The apparatus of claim 14, wherein said adjustable features are selected from the group consisting of biasing means, orifice control, and adjustable pump devices.

16. The apparatus of claim 1, further including means for creating a reduced pressure region behind jetter tool assembly for assisting in movement of said slurry flow.

17. The apparatus of claim 1, further including a tow point coupled to said front end of said base, said tow point adapted to attach with a cable pulled by a tow vessel.

18. A plow apparatus for making a trench in an underwater surface comprising:

a base including a front end and a back end;

a jetter tool assembly including a leading edge and a bottom edge, said jetter tool assembly coupled to said base proximate said front end and extending downwardly from said base, said jetter tool assembly including, an intake for accepting a volume of liquid input thereto; and at least one vent disposed at said leading edge, said vent being coupled to said intake and operable to output said volume of liquid at a predetermined rate of flow such that said flow is directed backward relative to said leading edge of said jetter tool assembly, further including a passive blade coupled to said base at a location behind said jetter tool assembly, said passive blade being substantially in-line with said trench made by said jetter tool assembly.

19. The apparatus of claim 18, wherein a leading edge of said passive blade is backward raked.

20. The apparatus of claim 18, wherein said passive blade includes means for guiding cable to be buried to within said trench.

21. The apparatus of claim 18, wherein said passive blade further includes a wing feature extending from each side of said passive blade.

22. A plow apparatus for making a trench in an underwater surface comprising:

a platform including a front end and a back end;

a jetter tool assembly pivotally coupled to said platform proximate said front end thereof, said jetter tool including at least one chamber, said chamber being coupled to a plurality of vents, wherein said vents are operable to direct a flow of liquid entering said chamber in a downward and backward direction relative said platform and substantially parallel to a leading edge of said jetter tool assembly to create a slurry flow underneath said jetter tool assembly; and at least one variable speed submersible pump for directing said flow of liquid into said chamber at a given rate.

23. The apparatus of claim 22, further including biasing means for downwardly biasing said jetter tool assembly.

24. The apparatus of claim 22, further including a passive blade coupled to said platform behind said jetter tool assembly.

25. The apparatus of claim 24, wherein said passive blade and said leading edge of said jetter tool assembly are backward raked.

26. The apparatus of claim 22, wherein said vents further include orifice control means for directing and varying said flow of said liquid.

27. The apparatus of claim 22, wherein the rate of flow supplied by said pump exceeds one half width W times depth D times plowing speed V to achieve a fluidized trench of at least said width W and said depth D at said plowing speed V.

28. A method of for making a trench in an underwater surface comprising the steps of:

providing plow apparatus including a jetter tool assembly pivotally coupled to a platform of said plow, said jetter tool assembly including a plurality of vents on a leading and bottom edge thereof;

pumping a given flow of liquid into said jetter tool assembly;

directing said flow of liquid through said vents in a downward and backward direction relative said platform and substantially parallel to a leading edge of said jetter tool assembly to create a slurry flow underneath said jetter tool assembly.

29. The method of claim 28, further including the step of plowing said trench created by said jetter tool assembly, during said step of directing, utilizing a passive blade coupled to said platform behind said jetter tool assembly.

30. The method of claim 28, further including the step of biasing said jetter tool assembly downwardly to achieve a given depth in said underwater surface during said step of directing.

31. The method of claim 29, further including the step of varying the rate and direction of said flow of liquid through said vents by adjustment of orifice control means coupled to said vents during said step of pumping.

32. The method of claim 29, wherein the rate of flow supplied by said step of pumping exceeds one half width W times depth D times plowing speed V to achieve a fluidized trench of at least width W and depth D at a plowing speed V.

33. The method of claim 28, further including the step of varying the output of at least one submersible pump coupled to said jetter tool assembly to control said flow of liquid exiting said vents.

* * * * *